US008884731B2

(12) United States Patent
Lesk

(10) Patent No.: US 8,884,731 B2
(45) Date of Patent: Nov. 11, 2014

(54) FASTENING FOR A SOLENOID

(75) Inventor: Hans-Kersten J. Lesk, Immenstadt (DE)

(73) Assignee: SVM Schultz Verwaltungs-GmbH & Co. KG, Memmingen (DE)

( * ) Notice: Subject to any disclaimer, the term of this patent is extended or adjusted under 35 U.S.C. 154(b) by 116 days.

(21) Appl. No.: 12/926,075

(22) Filed: Oct. 25, 2010

(65) Prior Publication Data

US 2011/0102115 A1 May 5, 2011

(30) Foreign Application Priority Data

Oct. 23, 2009 (DE) ..... 10 2009 050 564

(51) Int. Cl.
*H01F 7/08* (2006.01)
*H01F 7/127* (2006.01)

(52) U.S. Cl.
CPC ..... *H01F 7/127* (2013.01)
USPC ..... 335/220

(58) Field of Classification Search
USPC ..... 251/151.1–157.1, 129.1–129.22; 335/220–229
See application file for complete search history.

(56) References Cited

U.S. PATENT DOCUMENTS 6,935,612 B2 * 8/2005 McCombs et al. ..... 251/129.15
6,959,718 B2 * 11/2005 Kayahara et al. ..... 137/15.01
6,994,312 B2 * 2/2006 Pauer et al. ..... 251/129.18

* cited by examiner

*Primary Examiner* — Bernard Rojas
(74) *Attorney, Agent, or Firm* — Jacobson Holman Hershkovitz, PLLC.

(57) ABSTRACT

A loosing- and twisting-proof fastening for solenoids, in particular with a tube pipe receiving a magnet armature, and a coil element. The coil element can be fixed on the tube pipe via a fastening element.
On the tube pipe a safety element which can be brought into engagement with the tube pipe, on the one hand, and the coil element, on the other hand, is provided for a twisting-resistant arrangement of tube pipe and coil element.

18 Claims, 4 Drawing Sheets

FASTENING FOR A SOLENOID

Figure 1A:
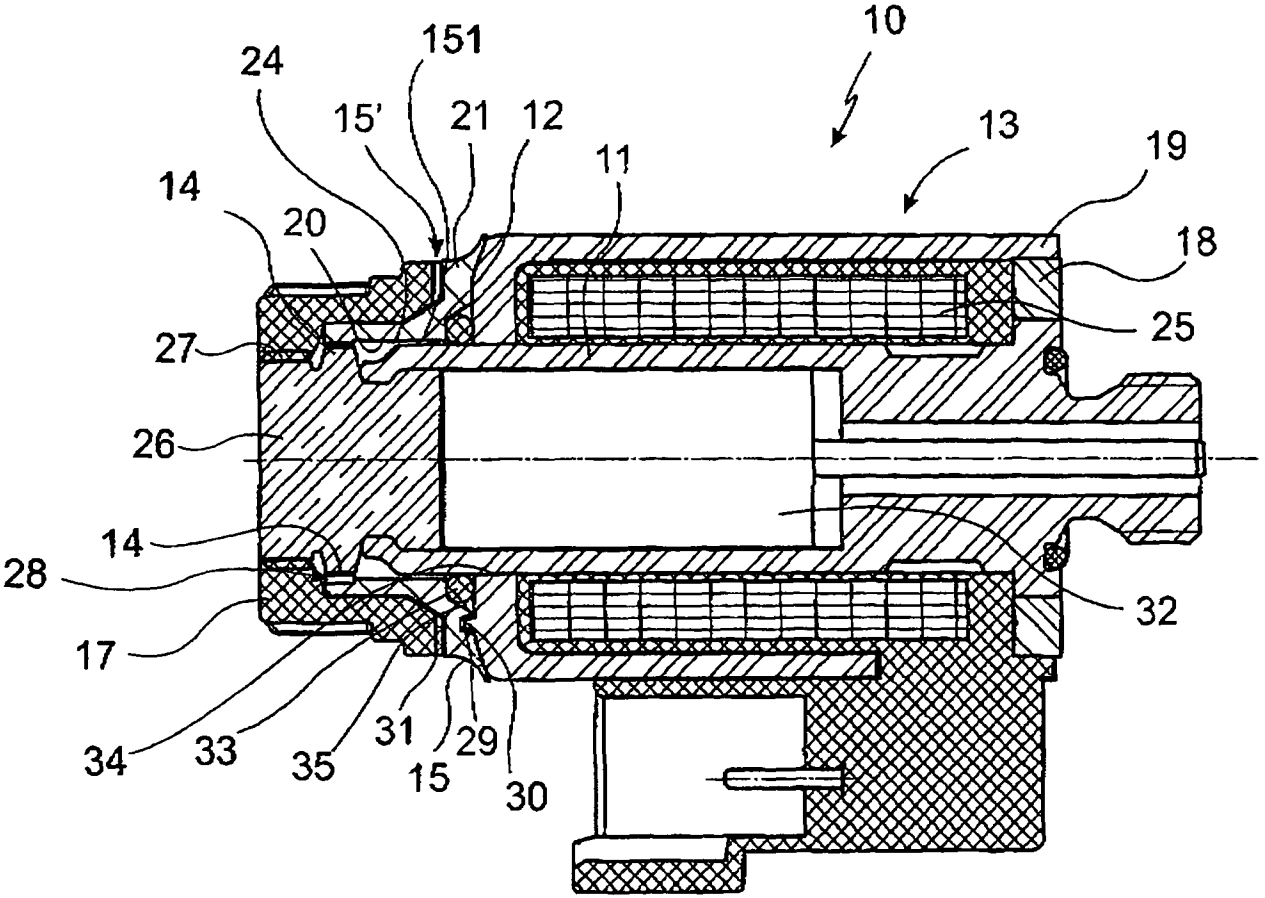

This application has a priority of German no. 10 2009 050 564.4 filed Oct. 23, 2009, hereby incorporated by reference.

The invention refers to a loosing-proof and twisting-proof fastening for solenoids.

BACKGROUND OF THE INVENTION

Solenoids are composed, as a rule, of several elements. These are, among others, a tube pipe receiving a magnet armature as well as a coil element, and, if necessary, a housing embracing or encircling the elements. In order to assemble the elements, as a rule, the coil element is slid on the tube pipe, and eventually fixed on the tube pipe with a fastening element, for example a nut. It is a disadvantage of the known solenoid that the coil element is arranged during mounting freely turning on the tube pipe, and therefore a defined fixing of the relative position cannot be carried until the fastening element has been screwed or put on. Another disadvantage of conventional solenoids is the fact that the fastening part, which is, for example, slipped on the tube pipe or screwed on a thread arranged on the tube pipe, can be loosened during the use of the solenoid, which always is accompanied by vibrations, and thus a working loose of tube pipe and coil element takes place which has unfavorable effects for the operation of the solenoid. The vibration can also cause the complete loosening of the fastening element from the other elements of the solenoid and the loss of it.

BRIEF SUMMARY OF THE INVENTION

Therefore it is an object of the present invention to provide a permanent twisting-proof and loosing-proof connection of the elements of a solenoid which can be realized in a simple and economic way.

In order to solve this problem a solenoid as described in the beginning is referred to which has, among others, a tube pipe receiving a magnet armature and a coil element. The coil element can here be fixed on the tube pipe through a fastening element. The solenoid according to the invention is characterized in that in a limiting surface of the coil element axially with reference to the longitudinal axis of the tube pipe and radial on the tube pipe each time at least one projection or recess, and a safety element which can be brought into engagement with the respective projection or the respective recess on the coil element or the tube pipe is provided for a twisting-proof arrangement of tube pipe and coil element. The projection, which can be arranged either on the tube pipe or on the coil element or on both of these elements, is preferably a catch. Besides, there is also the possibility of arranging here each time a toothing which is a series of projections and recesses. Besides arranging projections, of course, also a recess can be provided either on the tube pipe or the coil element or on both elements. With this recess or the respective projections or the toothing then the safety element, which has to be arranged additionally on the solenoid, is brought into engagement. The safety element thus engages, on the one hand, on the tube pipe, and, on the other hand, on the coil element, and by means of that effects a twist-free arrangement of tube pipe and coil element, and thus a fixing of the finally desired relative, position of tube pipe and coil element.

This has decisive advantages during mounting, as already before screwing or putting on the fastening element a positioning of tube pipe and coil element, the essential elements of the solenoid, has taken place, and thus the fastening element can be screwed on the tube pipe without delay without readjusting tube pipe and coil element. The fixing of the relative position is then carried out also by the position of the projections or recesses on the axial terminating surface of the coil element as the recess or the projections are arranged here in defined positions, and can be designed here in such a way that they can only engage with certain points, positions, recesses or projections on the safety element.

In order to be able to carry out a loosing-proof arrangement of the safety element it is seen as convenient when the safety element has an additional projection or an additional recess for engaging with the fastening element. It is provided here that the fastening element after putting or screwing on the tube pipe is brought into engagement with the respective projection or the respective recess on the safety element, and, by means of that, is fixed in its safety position. Here, first of all, the favourable design of the projection as catch can be taken into consideration which engages and catches in a corresponding structure on the fastening element, which can be designed, for example, in the shape of a toothing of individual projections or the like. The toothing or the projections on the safety element are here designed in such a way that the teeth slide, first of all, over the catch, while they deform it elastically, and, when a final position of the safety element is reached, allow bouncing back of the catch in one of the tooth catches of the safety element which leads finally to the fixing of the safety element on the solenoid. Releasing the safety element can only be done with increased force which is necessary to release the positive locking connection between catch and toothing on the safety element. A corresponding force does not occur either when the complete solenoid on the fastening element is impinged by vibrations so that here a loosing-proof arrangement of the fastening element is provided here and additionally a loosing-proof and twist-proof arrangement of the coil element on the tube pipe. Even without the arrangement of suitable catch elements on the safety element a protection against loosing of the fastening element is realized already by jamming or clamping the fastening element with the safety element.

Thus the concept according to the invention provides that in each case the safety element realizes, on the one hand, a protection against twisting for the tube pipe and the coil element or the coil element on the tube pipe, and, on the other hand, the same safety element provides a protection against loosing or an increasing of the releasing moment of the fastening element. Combining both functions in one element simplifies the construction of a solenoid essentially, and the time required for mounting is reduced. Thus, the result is an advantage in expenses as, on the one hand, the production costs for the solenoid are reduced, and, on the other hand, the repair costs are lowered by that as a permanent and safe connection of the elements of the solenoid is provided.

A preferred embodiment of the solenoid provides that the safety element is designed as sleeve. This sleeve has here a circumferential surface enclosing the tube pipe completely or partly. A partly or in sections circulating flange supported on the axial limiting surface of the coil element is connected with the circumferential surface. In the circumferential surface and in the flange each time at least one recess or at least one projection for engaging with the respective projection or the respective recess on the tube pipe and the coil form is provided. Here, for example, in the circumferential surface a toothing can be arranged, which can be brought into engagement with a corresponding counter toothing on the tube pipe. At the same time a recess receiving a corresponding projection on the coil element may be arranged in the flange.

It is provided according to the invention that the sleeve is formed of synthetic material or metal. For manufacturing the sleeve here all suitable working or production processes can be employed. If the sleeve is manufactured, for example, of synthetic material this can be done in an injection moulding process. If the sleeve is formed of metal, also a moulding process can be employed. Besides, there is the possibility of producing the sleeve in a deep-drawing or punching or pressing process. An advantage of the forming of the sleeve of synthetic material is its lighter weight caused by that as well as the rather low production costs. A sleeve of metal has proved to be particularly durable and lasting also if stressed severely over a longer period of time. During manufacturing of the sleeve in the above-mentioned processes already during manufacturing the sleeve seals or other elements can be integrated in the sleeve.

During assembly of the solenoid, first of all the coil element is put on the tube pipe, then the safety element is slid over the tube pipe the toothing on the circumferential surface being brought into engagement with the counter toothing on the tube pipe. After that the tube pipe is twisted so far relatively to the coil element until the projection on the axial limiting surface of the coil element is brought into engagement with the corresponding recess in the flange of the sleeve. By means of the engagement then the desired position of the coil element relatively to the tube pipe is fixed, and, finally, screwing or sliding of the fastening element fixing the elements of the solenoid in the position defined by the safety element can be carried out. At the same time, there is the possibility that on the circulating flange of the sleeve another projection is arranged, for example in the form of a catch pointing in the direction of the fastening element and which can be brought into engagement with it when the fastening element is screwed or slid on, so that by means of that a protection against loosing the fastening element can be realized, as it has already been explained before.

Preferably here the fastening element is designed as nut or cap which can be screwed or slid on the tube pipe. This has a surface extending parallel to the axial limiting surface of the coil element and facing the coil element, or a flange. In this surface facing the coil element or in the flange then again at least one projection or one recess is provided for the engagement with the safety element. This projection or recess can also be, as already described above, a single catch or a toothing which can be brought into engagement with corresponding counter elements on the safety element. If only a single projection or a single recess is provided the fixing of the fastening element is carried out by engaging this recess or projection with a corresponding element or with several suitably spaced positioned elements on the safety element. However, if this arrangement of a toothing is provided on the flange or the surface a defined orientation of the fastening element is not necessary to bring it into engagement with corresponding projections on the safety element. By means of this mounting the fastening element is made considerably simpler and can be carried out faster.

In this connection it is seen as advantage, if the safety element has, additionally to a toothing arranged parallel to the axis of the tube pipe and/or parallel to the plane of the limiting surface of the coil element, at least one projection or recess. This recess or projection then can be engaged with corresponding counter recesses or projections on the fastening element, the coil element or the tube itself, and can carry out here, on the one hand, the position definition of the tube pipe to the coil element, and, on the other hand, a fixing or improved protection against loosing of the fastening element.

Furthermore, it is seen as favourable when for fixing the relative position of tube pipe and coil element a toothing can be brought into engagement with a counter toothing, and a projection or a recess with a corresponding recess or a corresponding projection. The toothing and the counter toothing, respectively, are here provided in the safety element and engage in a correspondingly arranged toothing on the tube pipe or the coil element. Simultaneously with this engagement the recess or the projection is brought into engagement with a projection or a recess arranged also or alternatively on the tube pipe or the coil element, and thus the relative position is fixed. The design of the safety element is here adjusted to the design of the tube pipe and the coil element. Thus the safety element has then, for example, a toothing in an inner circumferential surface if a corresponding counter toothing is provided on the tube pipe. At the same time, the coil element can have a projection or a recess which is the cause that in the safety element a corresponding recess for the projection or a projection for putting in the recess is provided on or in the coil element. The toothing in the safety element allows a nonspecific, that means non-orientated, arrangement of the tube pipe. The desired position of the tube pipe in the coil element is fixed after the engagement of the safety element the toothing of which is already received in the counter toothing of the tube pipe. The safety element can additionally also be fixed via the engagement of the recess or the projection or the recess in the coil body.

Of course, there is also the possibility that a corresponding projection is arranged on the tube pipe which is connected with a recess, for example a groove in the circumferential surface of the safety element, and the safety element then has on its area, which may be designed e.g. as flange, facing the coil element or its axial limiting surface a toothing which can be connected with a counter toothing in or on the coil element, and through this then a fixing of the relative position of the tube pipe is carried out in the coil form. Besides there is finally also the possibility that on the tube pipe a recess, for example a groove or a bead is provided in which a corresponding projection in the circumferential surface of the safety element is introduced or fixed, so that here a first pre-fixing of the safety element on the tube pipe can be carried out, while the safety element then has other engagement elements on or at its surface facing the coil element or its circumference, which then again can be brought into engagement with a toothing, with a projection or a recess in the coil element, in order to carry out here a twisting-proof fastening of the tube pipe in the coil element.

Finally a free combination of the corresponding engaging or recess elements in the safety element as well as on the tube pipe and on the coil element is possible through which then a protection against twisting of the tube pipe in the coil element is reached. The final fixing of the coil element on the tube pipe is carried out by the fastening element which is slid or screwed on the tube pipe in order to be brought into engagement with the safety element after that. Thus the safety element takes over in two ways a task in the solenoid, on the one hand, the safety element arranges the twist protection of the tube pipe relatively to the coil element, and on the other hand, it presents the protection against loosing of the fastening element by fixing the final position of the slid or screwed on fastening element.

A preferred embodiment of the solenoid according to the invention provides that the counter toothing is provided on the tube pipe, and the projection or the recess on the coil element. As already described, there is, of course, also the possibility of a vice versa arrangement, that means that the counter toothing is arranged on the coil element, and the projection or the recess on the tube pipe. Another possible embodiment provides that on the coil element as well as on the tube pipe a counter toothing is provided which can be brought into engagement with corresponding toothings on the safety element. By a sole arrangement of toothings, on the tube pipe as well as on the coil element and on the safety element a particularly simple embodiment of the safety element can be realized as here an accurately positioned arrangement or putting in of recesses or projections does not have to be carried out in order to be nevertheless able to carry out a protection against twisting of the tube pipe on the coil element.

According to the invention it is provided that the safety element can be brought into engagement with the fastening element, and for that suitable projections, recesses, however preferably a catch or a toothing are provided on the safety element which are in engagement with a corresponding counter toothing or other catch means on the fastening element. In order to be able now to carry out a release of safety element and fastening element, to dismantle after that the solenoid, it is provided that the safety element has an unlocking device which can be operated in particular manually, with a tool or automatically for releasing the fastening element from the safety element and the subsequent releasing of tube pipe and coil element. This unlocking device can be formed, for example, by providing suitable engaging spots, for example openings on the safety element or fastening element in which a tool can be introduced to deform the catch or another projection on the safety element so far that the safety element is no longer in engagement with the fastening element, and therefore it can be pulled off or screwed off the tube pipe. A corresponding unlocking device makes a destroy-free release of the safety element from the fastening element possible, so that it can be reused.

Besides, there is, of course, the possibility to carry out a release by destroying the safety element. For that then suitable tools can also engage in the unlocking device, and destroy the safety element so that after that it releases the fastening element, and it can be screwed off or loosened from the tube pipe.

Besides the embodiment as sleeve it is provided, in a preferred development of the invention, that the safety element comprises an annular element including or encircling the tube pipe and/or the coil element. The annular element is supported here, at least in sections, on the coil element. This embodiment of the safety element reaches a further improved protection for, on the one hand, the tube pipe and the coil element against twisting, and, on the other hand, of the fastening element against loosing.

The annular element can have here at least one ring, however, preferably two rings which are connected to one another, for example, via a tongue or a bracket.

Thus, for example, when an annular element with two connected rings is used during mounting the solenoid, first of all, a releasable ring can be arranged on the coil element, after that, the relative position of the tube pipe and the coil element is fixed and the fastening element can be screwed or slid on, and, after that, another ring is put around the fastening element or is arranged, slid or jammed in it. If then the fastening element works loose from the tube pipe or out of its fixed position, despite the safety element, the second ring encircling the fastening element protects the fastening element against loosing, that means against the complete release from the solenoid. There is, of course, the possibility that a combination of a ring and a bow, a clamp or with a clasp is used, the ring being substituted by a suitable element.

A development of the invention provides that the annular element is connected releasable or fixedly with the coil element or the tube pipe. Here in particular, holding devices, projections or recesses, in which the annular element or one of its rings is put or slid in, slid or put on releasable or fixedly and thus with respect to the tube pipe or the coil element is fixed in its position at least on one end or in a defined area, can be provided on the coil element or tube pipe. The other end or another area of the annular element then can be connected releasable or by putting in suitable holding devices, projections or recesses fixedly with the fastening elements, and can here guarantee a protection against loosing.

At the same time there is the possibility of carrying out through the annular element a securing of the tube pipe on the coil element or the connection of tube pipe and coil element. The respective parts or sections of the annular element then are, on the one hand, fixed on the coil element, and, on the other hand, on the tube pipe, and only then the fastening element is put or screwed on the tube pipe.

It is seen as advantageous if in the solenoid according to the invention a seal element connected releasable or fixedly with the fastening element, the tube pipe or the coil element is provided. This seal element effects, on the one hand, a sealing of the inner area, and, on the other hand, an improved clamping or pre-tensioning of the fastening element towards the tube pipe or the coil element. The seal element in particular prevents moisture or dirt from intruding in the area between the tube pipe and the inner surface of the coil element which is in contact with the tube pipe during sliding on or in the mounting condition. The seal can here also be put in corresponding groove-like recesses in the safety element to be in contact here directly with the circumferential gap between tube pipe and coil element and be held there.

For mounting the solenoid the procedure is here, for example, the following: First of all, the coil element is slid on the tube pipe, then the seal is put on and, after that, the safety element is positioned on the coil element and on the tube pipe, after that, then the fastening element is slid on or screwed on the tube pipe, and the desired positioning or fixing of the elements of the solenoid is carried out. The seal can here be already integrated in the safety element, and is then slid on the tube pipe together with it.

Additionally there is the further possibility of arranging a seal on the upper face of the safety element facing the fastening element; the safety element may have for that also an annular recess or groove. Putting in the seal in the safety element is then carried out either already before this is put on the tube pipe and arranged on the coil element, or after putting at or on the safety element, and before mounting the fastening element. There is, of course, the possibility that the fastening element is equipped with jointing compound or a seal which can or must then be provided on the inside facing the tube pipe or the coil form.

The seal can also already be integrated in the safety element while it is manufactured, it can, for example, be glued in, sprayed in or melted in.

In order to prevent corrosion of the tube pipe, the safety element or the coil element, a favourable embodiment of the solenoid according to the invention provides that the tube pipe, the fastening element and/or the coil element is/are formed completely or at least partly of a corrosion-resistant material, in particular synthetic material. It is important here that only the non-current-carrying parts of the solenoid are manufactured of synthetic material. Here all synthetic materials are suitable which can be processed, for example, in a jet-moulding process. Besides, there is the possibility that the fastening element, the tube pipe or even parts of the coil element are cut or milled off solid material.

In order to improve fixing the fastening element on the tube pipe or the coil element, it is seen as advantageous if between the fastening element and the coil element a spring element is arranged. The spring element is compressed during screwing or putting on the fastening element, and clamps the fastening element together with the tube pipe. Here in particular, the embodiment of the tube pipe with a thread on which the fastening element can be screwed on has proven advantageous. The spring element can be designed, for example, as compression or disc spring, and be put in between the safety element and the fastening element. This arranging of the spring element is then carried out also during the mounting of the solenoid. Furthermore, there is the possibility of arranging a suitable spring element on the side of the safety element facing the fastening element already during its manufacturing. This leads to a simpler mounting and prevents the spring element from being forgotten to be put in during mounting.

An advantageous development of the solenoid according to the invention provides that the fastening element has at least on or in a surface facing the tube pipe or the coil element friction increasing means. These friction increasing means can be designed, in particular, as friction increasing covering, as additional structural rubber part, as ribs or naps or as adhesive surface which is provided either on the tube pipe or the coil element or the fastening means. By means of this, the protection against loosing of the fastening element already guaranteed by the safety element is further improved, as working loose of the fastening element from the tube pipe is made even more difficult.

An advantageous development of the solenoid provides furthermore that the coil element has a coil form. All above-mentioned embodiments of the solenoid according to the invention can be applied to it in the same way here that the mentioned elements are arranged, provided, put in the coil form itself. Besides the design of the coil element with a coil form, there is also the possibility that the coil element has a housing receiving the coil form. In this case also it is provided that the above-mentioned elements and embodiments of the solenoid have to be understood in connection with the housing as terminating surface or terminating area of the coil element.

BRIEF DESCRIPTION OF THE DIFFERENT VIEWS OF THE DRAWINGS

Figures 1B, 1C:
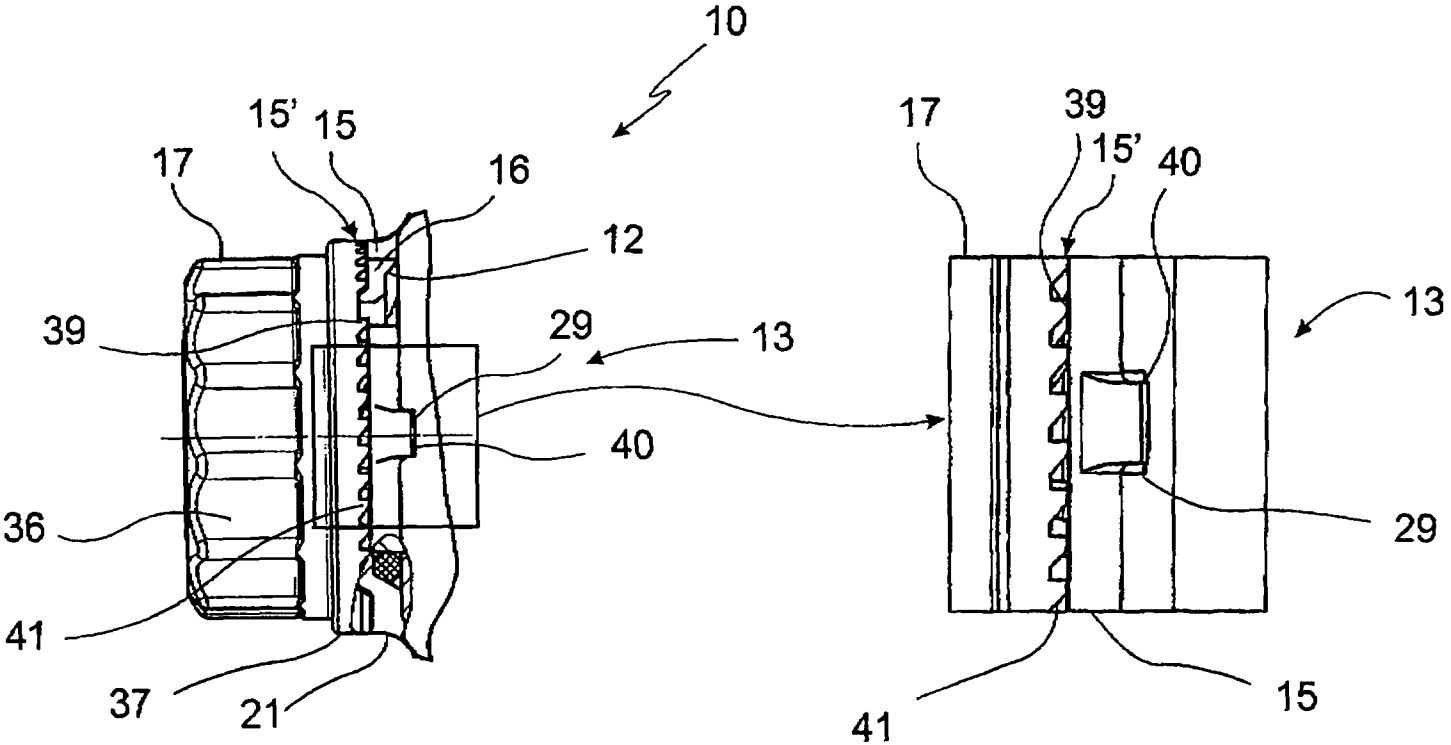

In the drawing the invention is shown schematically, in particular in one embodiment. In the drawings:

FIG. 1*a* a preferred embodiment of the solenoid according to the invention in a lateral sectional view;

FIG. 1*b* a detailed view of the terminating area of the solenoid according to the invention with a put-on fastening element in a side view;

FIG. 1*c* a detailed view of the cutout of the connection area between coil element and safety element indicated in FIG. 1*b;*

Figures 2A, 2B:
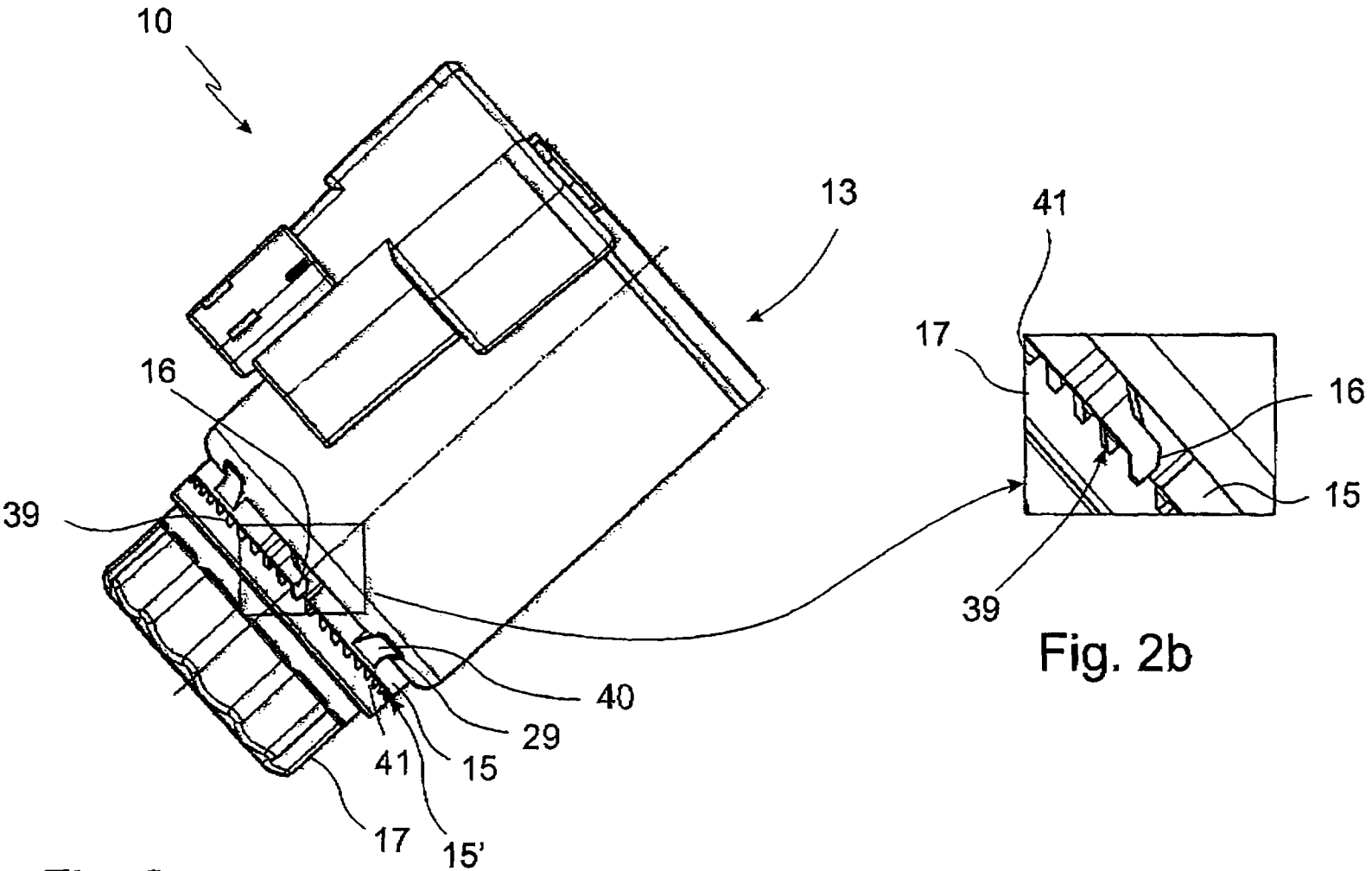

FIG. 2*a* another preferred embodiment of the solenoid according to the invention in a side view;

FIG. 2*b* an enlarged cutout of the area of the solenoid indicated in FIG. 2*a;*

Figures 3A, 3B:
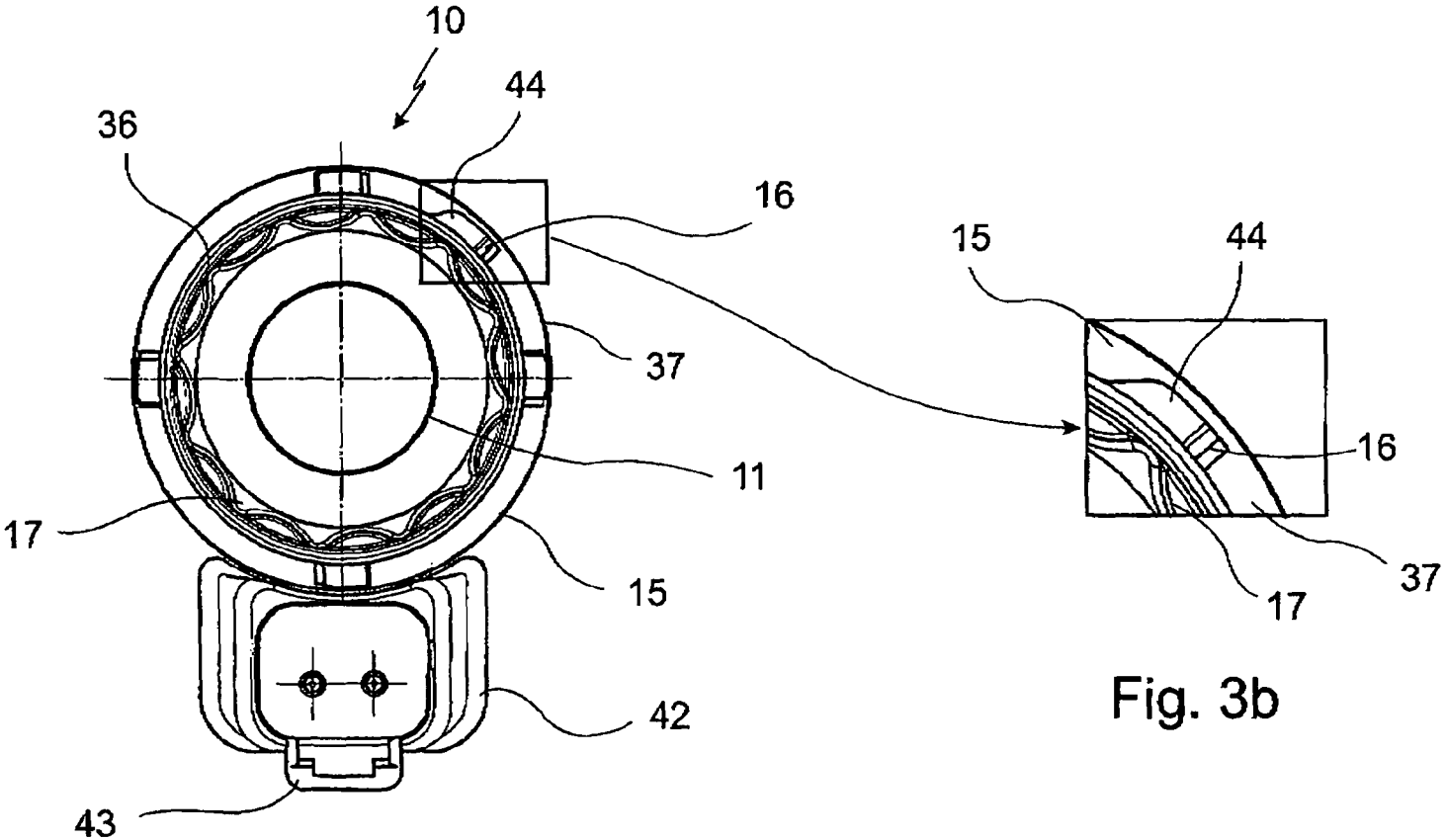

FIG. 3*a* a preferred embodiment of the solenoid according to the invention in a top view and FIG. 3*b* an outline of the area of the solenoid indicated in FIG. 3*a* in enlarged outline.

DETAILED DESCRIPTION OF THE PREFERRED EMBODIMENT

In the figures identical or corresponding elements each are indicated with the same reference numbers, and therefore are not described again, if not useful.

FIG. 1*a* shows an embodiment of the solenoid 10 according to the invention seen as advantageous in a lateral sectional view. The solenoid 10 comprises here a central tube pipe 11 on which a coil element 13 is put. The coil element 13 comprises here a coil 25 as well as the coil form 18 and is enclosed by a housing 19. The coil element 13 thus has to be seen as an independent element of the solenoid 10. During mounting the solenoid 10, the coil element 13 is slid on the tube pipe 11, and, after that, fixed by the fastening element 17 which is screwed on the left upper area in FIG. 1*a* of the yoke 26 limiting the tube pipe 11 in the embodiment. The fastening element 17 is designed in the example as nut. Of course, there is also the possibility here of designing the fastening element 17 as inserted sleeve or cap. For putting on the fastening element 17 the yoke 26 has a thread 27. Additionally to the thread 27 here a row of projections 14 is arranged which are combined in a row of teeth encircling the final area of the tube pipe 11 on the circumference. This row of teeth is suitable for interacting with a corresponding counter toothing 28 on a safety element 15 also provided in the solenoid according to the invention.

The safety element 15 is designed in the embodiment as sleeve which, after, the coil element 13 has been put on the tube pipe 11, is also slid on the tube pipe 11. By means of the safety element 15 a protection against twisting of the coil element 13 relatively to the tube pipe can be reached. For that the area of the inner circumference surface 20 of the safety element 15 equipped with the counter toothing 28 engages in the row of projections 14 designed as toothing on the circumference of the upper termination of the tube pipe 11, and effects that the safety element 15 can only be twisted together with the tube pipe 11. In order to reach now a twist-resistant fixing or a fixing of the relative position of the coil element 13 with reference to the tube pipe 11, on the upper axial limiting surface 12 of the coil element 13 a nose is arranged which can be brought into engagement with a recess 29 in the safety element 15 or the flange 21 of the sleeve, which is supported on the axial limiting surface 12 of the coil element 13. After the nose 30 is in engagement with the recess 29 no further twisting of the tube pipe 11 relatively to the coil element 13 can be carried, and the provided or desired position of the coil element 13 relatively to the tube pipe 11 is thus fixed.

After this has been fixed the fastening element 17 is put on or, in the example, is screwed on the limiting area of the tube pipe 11. During screwing on the fastening element 17 is put in contact with the upper side 31 of the flange 21. In the flange 21 here additional catching means are provided (see FIG. 2*b*) interacting with corresponding catch receivers on the fastening element 17 and providing here a protection against loosing, that means a protection of the fastening element 17 against an unintentional working loose from the tube pipe 11.

For mounting the solenoid 10 first of all, as already described, the coil element 13 is slid on the tube pipe 11 which again serves as receiver for a magnet armature 32. After that, for a first pre-fixing of the coil element 13 on the tube pipe 11 a packing ring 33 is slid on the tube pipe 11 and seals the gap 34 between the coil element 13 and the tube pipe 11 against intruding moisture or intruding dust. After the packing ring 33 has been put on, the safety element 15 is also slid or slipped on the tube pipe 11, and here the counter toothing 28 on the safety element 15 is brought into engagement with the projections 14 or the thus formed row of teeth on the tube pipe 11.

The safety element 15 has a flange 21 which is in contact with axial limiting surface 12 of the coil element 13. This flange 21 has in the area of the packing ring 33 an annular groove 35 providing a contact shoulder for the packing ring 33, and thus causes pressing the packing ring 33, on the one hand, to the axial limiting surface 12, and, on the other hand, to the tube pipe 11. The axial circumference surface 20 of the safety element 15 is now in contact in sections with the circumferential surface of the tube pipe 11. The safety element 15 is turned on the tube pipe 11 so far until the nose 30 provided in the axial limiting surface 12 of the coil element is brought into engagement with a recess 29 which is arranged for this purpose in the flange 21. By means of this connection which is a sort of catching, the relative position of the tube pipe 11 is fixed with reference to the coil element 13, and another twisting of the coil element 13 on the tube pipe 11 is not possible anymore.

The last assembly step is now screwing the fastening element 17 on the final area of the tube pipe 11 or the thread 27 cut in the yoke 26. This presses the safety element 15 further to the coil element 13 or its axial limiting surface 12. At the same time, suitable catch elements, which are provided orientated on the flange 21 in the direction of the fastening element 17, are brought into engagement with a circumferential surface of the fastening element 17 and thus a loosing-proof arrangement of the fastening element on the tube pipe 11 or the solenoid 10 is carried out.

Instead of a row of projections on the tube pipe 11 here only one single projection can be provided which is brought into engagement with a corresponding receiving area on the safety element 15, before a final fixing of the safety element 15 on the axial limiting surface 12 of the coil element 13 is done. Besides, it is also possible that in the tube pipe 11 or its end area a groove-like recess is provided in which a projection provided on the circumferential surface 20 of the safety element 15 is put or slid in, and carries out here a pre-fixing of the safety element 15.

In order to improve fixing the fastening element 17 on the tube pipe 11 or the coil element 13, it is seen as advantageous if between the fastening element 17 and the coil element 13 a spring element 15' is arranged. The spring element 15' can be designed, for example as compression or disk spring, and be put in between the safety element 15 and the fastening element 17.

The solenoid provides that the fastening element 17 has at least on or in a surface facing the tube pipe 11 or the coil element 13 friction increasing means 151. These friction increasing means can be designed, in particular, as friction increasing covering, as additional structural rubber part, as ribs or naps or as adhesive surface which is provided either on the tube pipe 11 or the coil element 13 or the fastening means 17.

FIG. 1*b* shows a sectional outline of the fastening element 17 after mounting on the solenoid 10 according to the invention. The fastening element 17 has on its outer circumferential surface grooves 36 which improve, during mounting of the solenoid 10, the engaging of the tools. Furthermore here also a manual assembly of the fastening element 17 can be carried out. The fastening element 17 has a circumferential flange 37 with a toothing 39 on its flange upper side facing the safety element 15. This toothing 39 serves for engaging with catches 16 so that a protection of the fastening element 17 against unintentional working loose from the tube pipe is possible. This catch 16 is integrated in the surface of the flange 21 of the safety element 15 facing the fastening element 17. The catch 16 is designed as elastic element and, because of the tooth shape of the toothing 39, is bent during screwing of the fastening element 17 on the tube pipe 11 by the teeth 41 in the direction of the coil element 13 so far that the teeth 41 slide over the catch 16. After finishing screwing the fastening element 17 the catch 16 springs back in its initial position, and engages there in a gap between two teeth 41 of the toothing 39. Because of the design of the teeth 41 with a steep edge and a flat edge, screwing off the fastening element 17 from the tube pipe can only be done with increased efforts of power. Therefore, screwing off has to be done intentionally, an unintentional screwing off of the fastening element 17 is not possible because of the engagement of catch 16 and toothing 39.

Neither is a working loose of the fastening element 17 because of vibrations of the solenoid possible.

In the embodiment of FIG. 1*b* the axial limiting surface 12 of the coil element 13 has neither projection nor catch 30 which could be brought into engagement with a corresponding recess 29 in the safety element 15. In this example rather a recess 29 is provided in the axial limiting surface 12 of the coil element 13 in which a tongue-like projection 40 on the safety element 15 engages. Corresponding projections 40 can be arranged evenly distributed over the circumference of the safety element 15. Suitable recesses 29 in the coil element 13 can be distributed correspondingly. During mounting the solenoid 10, after the coil element 13 has been put on the tube pipe 11, the safety element 15 is slid on the tube pipe 11 in such a way that the tongue-like projections 40 are in engagement with the recesses 29. The safety element then has on its circumferential surface 20, which is in contact with the tube pipe 11, a toothing 39 which again is connected with a counter toothing in the tube pipe 11 (not discernible in FIG. 1*b*), and effects a protection against twisting of tube pipe 11 and coil element 13. After putting on the safety element 15, then again a screwing on of the fastening element 17 is carried out. After that, then the elastic deformation of the catch 16 takes place until the final fastening position of the fastening element 17 has been reached.

FIG. 1*c* shows an enlarged cutout of the area of the safety element 15 or the fastening element 17 indicated in FIG. 1*b*. Here the toothing 39 as well as the tongue-like projection 40 and the recess 29 in the coil element 13 can be seen clearly. The shape of the teeth 41 with a steep tooth edge and a flatter tooth edge, which makes sliding over the catch 16 or catching of the catch 16 with the toothing 39 easier, can be seen here better. Another possibility for forming the safety element 15 provides that it is manufactured from metal. Here the tongue-like projections 40, which can be seen in FIG. 1*c*, can be bent, after the safety element 15 has been put on, in their position on the coil element 13, and so a fixing of the safety element 15 can be carried out.

FIG. 2*a* shows another preferred embodiment of the solenoid 10 according to the invention in a side view. The outline of the catches 16 engaging in a toothing 39 is pointed out specifically. The fastening element 17 is shown here in its end position on the solenoid 10. This also comprises, in the embodiment of FIG. 2*a*, a coil element 13 which is slid on a non-visible tube pipe 11, and has been fixed by the fastening element 17. The safety element 15 arranged between the coil element 13 and the fastening element 17 has the catch 16 which can be brought into engagement with the toothing 39. During screwing the fastening element 17 on the tube pipe 11 the teeth 41 deform, first of all, the catch 16 elastically, until, after reaching the end position of the fastening element 17, more screwing is not possible, and the catch 16 has been caught elastically in the gap between two teeth 41, and by that the fastening element is caught together with the safety element 15. The safety element 15 itself is fixed on the coil element 13 via the tongue-like projections 40 engaging in corresponding recesses 29 on the coil element 13.

In FIG. 2*b* the area indicated in FIG. 2*a* is shown enlarged so that here the catch 16 provided on the safety element 15 can be discerned better. The toothing 39, which is provided in a circumferential flange 37 of the fastening element 17, can also be discerned clearly. The toothing 39 is integrated in the fastening element 17 during its manufacturing, for example formed in or cut in, and has teeth 41 with one steep and one flat flank. The flat flank serves, during screwing on the fastening element 17, for deforming the catch 16 so that gliding of the toothing 39 over the catch element is possible. During the subsequent catching of the catch 16 with the toothing 39 the catch is in contact with the steep edge of the tooth 41. During screwing on the fastening element 17 more power has to be exerted to get the catch 16 out of the catching position in a releasing position. This makes sure that the fastening element 17 cannot be screwed off unintentionally or loosened by vibrations form the tube pipe 11 unintentionally.

FIG. 3*a* shows the solenoid 10 according to the invention in a top view. Here the connection elements 42 which are arranged in a separate add-on piece 43 on the solenoid 10 can be discerned. As these elements are not decisive for the actual invention, these elements of the solenoid 10 will not be discussed further. The solenoid 10 according to the invention comprises in the embodiment of FIG. 3*a* a fastening element 17 screwed on the tube pipe 11. The fastening element 17 has a circumferential flange 37, in which openings 44 are provided which offer an access to the catch 16 on the safety element 15, the catch being in engagement with a toothing 39 provided on the flange surface. Via these openings 44 for dismantling the fastening element 17 the catch 16 can be accessed and it can be deformed out of its catch position in the toothing 39 into a release position. This makes a loosening of the fastening element 17 from the tube pipe 11 possible without any problems. For a better assembly or dismantling of the fastening element 17 it has grooves 36 on its outer surface.

In FIG. 3*b* the cutout indicated in FIG. 3*a* is shown enlarged. Here the opening 44 in the circumferential flange 37 can be seen clearly through which access to the catch 16 is possible. Besides the shown embodiment there is also the possibility that the circumferential flange 37 has a smaller diameter than the flange 21 of the safety element. In this case the catch 16 can be accessed from the outside so that an opening 44 does not have to be provided in the circumferential flange 37 of the fastening element 17 in order to release here the catch 16 from the toothing 39.

Although the invention has been described by exact examples which are illustrated in the most extensive detail, it is pointed out here that this serves only for illustration, and that the invention is not necessarily limited to it because alternative embodiments and methods become clear for experts in view of the disclosure. Accordingly changes can be considered which can be made without departing from the contents of the described invention.

The invention claimed is:

1. A solenoid comprising a tube pipe, a magnet armature received in the tube pipe, a coil element, the coil element being fixed on the tube pipe via a fastening element, and a limiting surface of the coil element being located axially with reference to a longitudinal axis of the tube pipe and radially on the tube pipe, a safety element comprising at least one projection or one recess engaging with a respective projection or a respective recess on the coil element or the tube pipe so that the tube pipe and the coil element do not twist relative to each other.

2. The solenoid according to claim 1, wherein the safety element has an additional projection or an additional recess, respectively, for engagement with the fastening element.

3. The solenoid according to claim 1, wherein at least one of the projection and the recess is designed as a catch.

4. The solenoid according to claim 1, wherein the fastening element is a nut or cap screwed or put on the tube pipe, with a surface extending parallel to the limiting surface of the coil element and facing the coil element or a circumferential flange, wherein on or in the limiting surface at least one projection or one recess is provided for engaging with the safety element.

5. The solenoid according to claim 1, wherein the safety element has, in addition to a toothing arranged parallel to the axis of the tube pipe or parallel to the limiting surface of the coil element, at least one projection or one recess.

6. The solenoid according to claim 1, wherein the safety element has an unlocking device so that the tube pipe and the coil element can twist relative to each other.

7. The solenoid according to claim 1, wherein the safety element is a sleeve with an inner circumferential surface encircling the tube pipe either completely or partly, and with a partly or in sections circulating flange, which is connected completely or in sections with the circumferential surface, and is supported on the limiting surface of the coil element, wherein the circumferential surface and the flange each at least have the at least one recess and/or the at least one projection for engaging with the respective projection or the respective recess on the tube pipe and on the coil element.

8. The solenoid according to claim 1, wherein a sleeve is provided, and the sleeve is formed of synthetic material or metal.

9. The solenoid according to claim 1, wherein for fixing a relative position of the tube pipe and the coil element a toothing is brought into engagement with a counter toothing.

10. The solenoid according to claim 1, wherein a relative position of the tube pipe and the coil element is fixed by a toothing on the safety element brought into engagement with a counter toothing on the tube pipe.

11. The solenoid according to claim 1, wherein the safety element includes an annular element encircling the tube pipe and having at least one ring, and the annular element is supported at least in sections on the coil element.

12. The solenoid according to claim 1, wherein the safety element includes an annular element encircling the tube pipe and having at least one ring, and the annular element is connected with the coil element or the tube pipe releasably or fixedly, via holding devices, projections or recesses provided on the coil element or the tube pipe.

13. The solenoid according to claim 1, wherein a sealing element is provided which is connected releasably or fixedly with the fastening element, the tube pipe and/or the coil element.

14. The solenoid according to claim 1, wherein a sealing element is provided which is connected releasably or fixedly with the fastening element, the tube pipe and/or the coil element, and the tube pipe, the fastening element and/or the coil element is/are formed completely or partly of a corrosion-resistant material.

15. The solenoid according to claim 1, wherein a spring element is arranged between the fastening element and the coil element.

16. The solenoid according to claim 1, wherein the fastening element has at least a friction increasing covering on or in a surface facing the tube pipe or the coil element.

17. The solenoid according to claim 1, wherein the coil element has a coil form.

18. The solenoid according to claim 17, wherein the coil element has a housing receiving the coil form.

* * * * *